United States Patent [19]

Philippbar

[11] Patent Number: 4,479,035

[45] Date of Patent: Oct. 23, 1984

[54] CERAMIC VOICE COIL ASSEMBLY

[76] Inventor: Jay E. Philippbar, 33821 Castano Dr., Dana Point, Calif. 92629

[21] Appl. No.: 497,269

[22] Filed: May 23, 1983

[51] Int. Cl.[3] ..... H04R 9/04

[52] U.S. Cl. ..... 179/115.5 VC; 29/594; 242/118.32

[58] Field of Search ..... 179/115.5 VC, 115.5 R; 335/222, 299; 29/594, 602 A, 605; 242/118.32, 118.7

[56] References Cited

U.S. PATENT DOCUMENTS

| | | | |
|---|---|---|---|
| 3,358,088 | 12/1967 | Gault | 179/115.5 VC |
| 3,872,360 | 3/1975 | Sheard | 361/311 |
| 3,935,402 | 1/1976 | Gersten | 179/115.5 VC |
| 4,322,583 | 3/1982 | Maeda | 179/115.5 VC |
| 4,322,584 | 3/1982 | Shimada et al. | 179/115.5 VC |
| 4,424,026 | 1/1984 | Schleimann-Jensen | 432/125 |

FOREIGN PATENT DOCUMENTS

| | | | |
|---|---|---|---|
| 383684 | 11/1932 | United Kingdom | 179/115.5 VC |

*Primary Examiner*—Gene Z. Rubinson
*Assistant Examiner*—Danita R. Byrd
*Attorney, Agent, or Firm*—W. Edward Johansen

[57] ABSTRACT

The present invention is a ceramic voice coil assembly for use in a loudspeaker system which includes a ceramic voice coil form which is formed out of a high temperature ceramic material such as $Al_2O_3$, BeO or glass and which has an outer surface and an inner surface. The ceramic voice coil assembly also includes transducer windings having a first end and a second end which are formed by a molybdenum-manganese metallization which is disposed on either the outer surface or the inner surface of the voice coil form and lead wires which are mechanically and electrically coupled to the first and second ends of the transducer windings. The lead wires are either brazed or welded to the ends of the transducers windings. The lead wires may be electrically coupled to either an amplifier or a servo drive circuit of a voice coil linear motor.

7 Claims, 4 Drawing Figures

CERAMIC VOICE COIL ASSEMBLY

BACKGROUND OF THE INVENTION

1. Field of the Invention

The present invention relates to voice coil assemblies for use in loudspeakers or other apparatus which transform electrical signals into mechanical motion and more particularly to a voice coil assembly which includes a ceramic voice coil form and transducer windings formed by a molybdenum-manganese metallization onto the voice coil form.

2. Description of the Prior Art

Presently a voice coil assembly includes a voice coil form which is generally formed out of either thin paper or thin aluminum. The voice coil assembly also includes at least one insulated wire which is generally formed out of either copper with an enameled coating or aluminum with a thin anodized coating and which is wound onto the voice coil form. The insulated wire may be in the form of a ribbon to increase the winding efficiency. Adhesives which are either one of the many high temperature epoxies or clear enamel coatings are used to secure the windings in place after the insulated wire is wound onto the voice coil form.

U.S. Pat. No. 3,935,402, entitled Loudspeaker Voice Coil Arrangement, issued to Martin Gersten, on Jan. 27, 1976, teaches a loudspeaker voice coil assembly which has improved power handling capability. The loudspeaker voice coil assembly is wound of rectangular cross-section aluminum wire having a flexible anodized coating. A thin aluminum cylindrical voice coil form having an anodized coating is adhered to the windings of the loudspeaker voice coil assembly with a thin coating of a cement. The anodized coating on the aluminum wire serves not only to electrically insulate the turns one from another and from the aluminum, heat-radiating thin aluminum voice coil form, but also serves to enhance the efficiency of the cement bonding. There is a reliability problem in this type of voice coil assembly because it is difficult to lead/tin solder aluminum wire even when using aluminum fluxes for which there are no known Military specifications. In static tests performed on a work bench in open air, no magnetic loading or mass to accelerate or decelerate these loudspeaker voice coil assemblies have continuously dissipated 150 watts rms audio power. In dynamic tests of this type of voice coil assembly wherein not only is the voice coil form heated to a reasonable operating temperature, but is also subjected to a high energy, low frequency transient signal to its transducers windings, the voice coil assembly will blow up.

U.S. Pat. No. 4,376,233, entitled Securing of Lead Wires to Electro-Acoustic Transducers, issued to Yoshiyuki Kamon and Yoshihiro Yokoyamo on Mar. 8, 1983, teaches an electro-accoustic transducer of the dynamic type, particularly a small loudspeaker or microphone, such as a loudspeaker for use in headphones includes a magnetic circuit including an air gap, a diaphragm having a voice coil assembly disposed in the air gap, and lead wires for the voice coil assembly with the lead wires extending substantially tangentially from the voice coil and being bonded to the diaphragm by two different kinds of adhesive, a relatively hard adhesive being used near the voice coil and a relatively soft adhesive being used near the periphery of the diaphragm.

U.S. Pat. No. 4,322,583, entitled Voice Coil Bobbin Connection to Loudspeaker Diaphragm of Honeycomb Core Sandwiched by Sheets, issued to Keijiro Maeda on Mar. 30, 1982 teaches a diaphragm for a flat electro-acoustical transducer such as a loudspeaker which includes first and second sheet members having a honeycombed core structure sandwiched therebetween each and includes an interconnection between each diaphragm and the voice coil form to avoid shifts and delays in transmitting vibration to each diaphragm and eliminate the tendency to introduce extraneous auditory sound.

U.S. Pat. No. 4,322,584, entitled Voice Coil Bobbin for Planar Diaphragm, issued to Kunihiko Shimade and Yukio Tsuchiya on Mar. 30, 1982 teaches a voice coil form for construction which includes plural voice coil form frames which are joined and bonded together to form the composite voice coil form.

U.S. Pat. No. 3,358,088, entitled Electromechanical Transducer, issued to Robert A. Gault on Dec. 12, 1967, teaches an electromechanical transducer which has a thermally conductive material which is bonded in close thermal proximity to the transducer windings of the voice coil assembly in order to increase the rate of heat dissipation of heat from the transducer windings thereby appreciately increasing the wattage rating of the voice coil assembly.

U.S. Pat. No. 3,656,015, entitled Combined Linear Motor and Carriage, issued to Donald E. Gillum on Apr. 11, 1972, teaches a voice coil linear motor.

U.S. Pat. No. 4,270,073, entitled Position Control in Disk Drive System, issued to Jefferson H. Harman on May 26, 1981, teaches a voice coil type linear motor controls the movement and positioning of a transducer which cooperates with a spinning disc.

U.S. Pat. No. 4,149,201, entitled Transducer Centering System, issued to Daniel C. Card on Apr. 10, 1979, teaches an improved transducer centering system which includes a voice coil linear motor.

Voice coil assemblies of the types described above are subject to a variety of different kinds of failures. The voice coil form which is formed out of a thin and flexible material may deform from its desired circular geometry and contact the magnet or the pole piece. This contacting will result in distorted audio reproduction and eventually will wear through both the voice coil form and the insulated windings thereby creating a partial electrical short. The use of a stiffer voice coil form eliminates the problem of contacting.

When an amplifier overheats the voice coil assembly it may become shorted because the enamel coating on the copper wire will burn off causing a loss of insulation between the windings resulting in a short circuit. The enameled coating of a conventional insulated copper wire will carbonize or otherwise fail at about 250° C. The use of aluminum wire having an anodized coating rather than the conventional enamel copper wire means that the thermal dissipation is limited only by the melting point of the aluminum wire rather than by the thermal destruction of the enameled coating. The thin anodized coating on either the aluminum wire or the aluminum ribbon has good insulating properties up to the melting point of the aluminum wire before its insulating properties are lost. However, the voice coil assembly which is made with an aluminum wire with a thin anodized coating in the range of one micron is only as good as the epoxy that holds it together. Once the windings break free from the epoxy, rubbing between the windings will occur and easily break down the super thin anodized coating on the aluminum wire thereby resulting in intermittant shorts and/or dead shorts. Each turn of the windings is bonded to each of the adjacent turns of the windings and to the inner cylindrical surface of the voice coil forming a very firm, interdigitated bond. The adhesive is a commercially available epoxy, polyamide cement. There are windings of a voice coil assembly which are capable of dissipating 150 rms audio watts continuously or 250 rms audio watts programmed and which have withstood voice coil assembly operating temperature in excess of 250° C. The dimensional stability of the voice coil assembly is assured from room temperature to 250° C. because both the voice coil winding conductors and the heat dissipating voice coil form are made of the same material and hence have the same coefficent of expansion.

An amplifier of even medium power in the range of 100 watts can overdrive a voice coil assembly having a thin paper voice coil form thereby easily "burning up" the thin paper voice coil form. When the user operates the voice coil assembly at high temperature he may displace windings by softening up the epoxy which secures the windings on the voice coil form so that the epoxy looses its tensile strength thereby allowing the windings to blow off of the voice coil form. The blowing off of the windings will also cause them to come in with either the magnet or the pole piece producing audio distortion. The windings may also break loose from the voice coil form and from the epoxy adhesive thereby allowing the windings to rattle around freely. The rattling of the windings will fatigue the wire of the windings and eventually the voice coil assembly will electrically open up. The insulated wires are attached by conventional soldering using solder with an appropriate flux such as aluminum flux for the aluminum wire. The adhesive material may also be a ceramic cement for attaching the windings to the voice coil form.

SUMMARY OF THE INVENTION

In view of the foregoing factors and conditions which are characteristic of the prior art it is the primary object of the present invention to provide a voice coil assembly having a ceramic voice coil form with transducer windings formed by a molybdenum-manganese metallization onto the ceramic voice coil for use in loudspeakers or other apparatus for transforming electrical signals into mechanical motion.

It is another object of the present invention to provide a voice coil assembly which will not only operate at an extremely high temperature such as 1200° C. without failing, but will also handle extremely high power pulses due to its solid state construction regardless of its temperature.

It is still another object of the present invention to provide a voice coil assembly which is virtually indestructible regardless of its temperature.

In accordance with the present invention an embodiment of a ceramic voice coil assembly for use in a loudspeaker system is described. The ceramic voice coil assembly includes a ceramic voice coil form which is formed out of a high temperature ceramic material such as $Al_2O_3$, BeO or glass and which has an outer surface and an inner surface. The ceramic voice coil assembly also includes transducer windings having a first end and a second end which are formed by a molybdenum-manganese metallization which is disposed on either the outer surface or the inner surface of the voice coil form and lead wires which are mechanically and electrically coupled to the first and second ends of the transducer windings. The lead wires are either brazed or welded to the ends of the transducers windings. The lead wires are electrically coupled to either an amplifier or a servo drive circuit of a voice coil linear motor.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
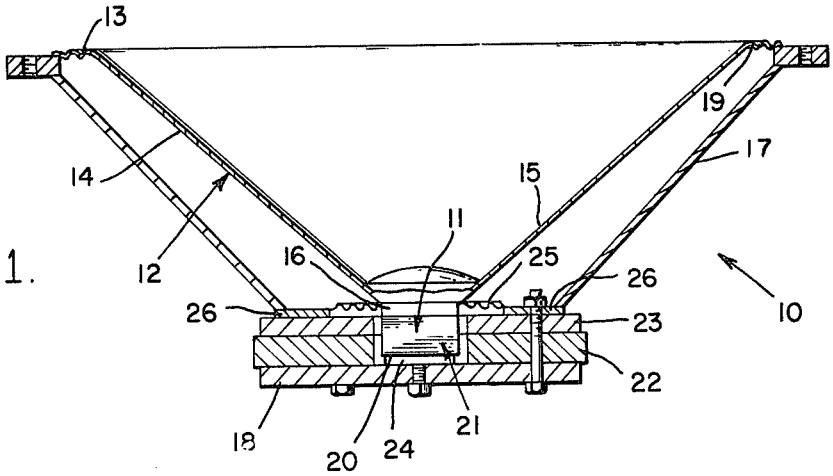
FIG. 1 is a side elevational view in cross-section of a loudspeaker which has an improved voice coil assembly which has been constructed in accordance with the principles of the present invention.

In order to best understand the present invention it is necessary to refer to the following description of its preferred embodiment in conjunction with the accompanying drawing. Referring to FIG. 1 a low frequency loudspeaker system 10 includes an improved voice coil assembly 11, a conically shaped diaphragm 12 having a front peripheral edge 13, an external sidewall 14, an internal sidewall 15 and a base peripheral edge 16 and a frame 17 having a back plate 18 and a conically shaped portion for receiving the diaphragm 12. The low frequency loudspeaker system 10 also includes a surround 19 which mechanically couples the front peripheral edge 13 of the diaphragm 12 to the frame 17.

Referring still to FIG. 1 the improved voice coil assembly 11 includes a cylindrically-shaped, ceramic voice coil form 20 which is mechanically coupled to the base peripheral edge 16 of the diaphragm 12 and transducer windings 21 which are mechanically coupled to the ceramic voice coil form 20. The low frequency loudspeaker system 10 further includes a ring-shaped magnet 22 and a front plate 23 which are disposed about the transducer windings 21 and which are mechanically coupled to the back plate 18 and a cylindrical iron pole piece 24 which is disposed within the voice coil form 20 and which is also mechanically coupled to the back plate 18. The ring-shaped magnet 22, the front plate 23 and the pole piece 24 create a magnetic gap across the transducer windings 21 of the improved voice coil assembly 11. A centering spider 25 mechanically couples the base peripheral edge 16 of the diaphragm 12 to the base portion 26 of the frame 17 and centers the transducer windings of the improved voice coil assembly 11 within the magnetic gap. U.S. Pat. No. 4,379,952, entitled Mechanical Filter for an Electrodynamic Transducer, issued to Adrianus J. M. Kaiser and Wiert Kopinga on Apr. 12, 1983 teaches a loudspeaker system including voice coil form and transducer windings.

Figure 2:
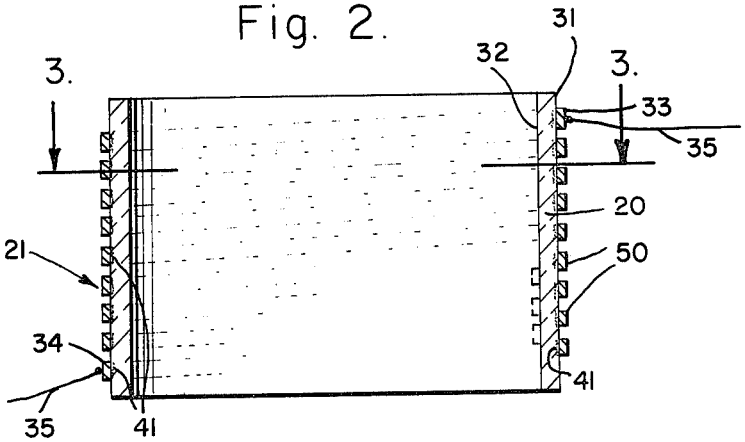
FIG. 2 is a side elevational view in cross-section of the improved voice coil assembly of FIG. 1.
Figure 3:
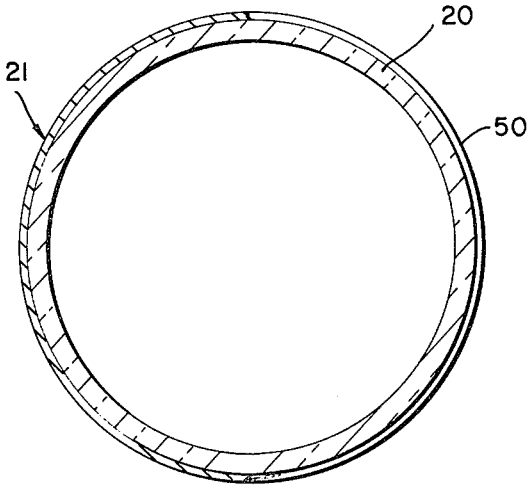
FIG. 3 is a transverse cross-sectional view of the improved voice coil assembly of FIG. 1 taken the line 3—3 of FIG. 2.

Referring to FIG. 2 in conjunction with FIG. 3 the the ceramic voice coil form 20 is formed out of a high temperature ceramic material such as $Al_2O_3$, BeO or glass and has an outer surface 31 and an inner surface 32. The transducer windings 21 have a first end 33 and a second end 34 and are formed by a molybdenum-manganese metallization which are disposed on either the outer surface 31 or the inner surface 32 of the ceramic voice coil form 20. Lead wires 35 are mechanically and electrically coupled to the first and second ends 33 and 34 of the transducer windings 21. The lead wires 35 are either brazed or welded to the first and second ends 33 and 34 of the transducers windings 21. The lead wires 35 are electrically coupled to either an audio amplifier or a servo drive circuit for a voice coil linear motor.

Figure 4:
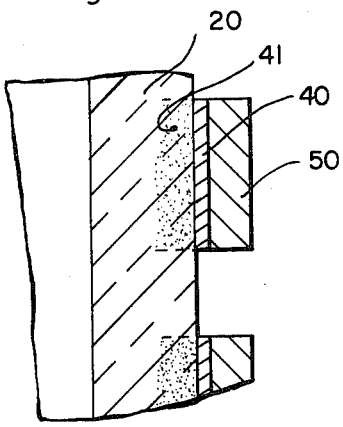
FIG. 4 is an enlarged side elevational view in cross-section of a portion of the improved voice coil assembly of FIG. 1.

Referring to FIG. 4 the ceramic voice coil form 20 is formed out of aluminum oxide, beryllium oxide, glass or any other high temperature ceramic material. The transducer windings 21 are formed by a molybdenum-manganese metallization 40 which is sprayed or painted on either the outer surface 31 or the inner surface 32 of the ceramic voice coil form 20. The ceramic voice coil form 20 and the transducer windings 21 are fired at an extremely high temperature about 1600° C. Some of the metallization 41 will penetrate the ceramic voice coil form 20. The resistance of the metallized transducer windings 21 can be tightly controlled by electrolytic or electroless plating 50 of a conductive metal such as nickel, copper or silver. If a more precise voice coil resistance is required the metallized transducer windings 21 may be either laser trimmed or dipped into an acidic solution without sacrificing performance. Once the metallization is fired the improved voice coil assembly 11 it is virtually indestructible regardless of its temperature.

The improved voice coil assembly 11 can be operated up to the melting point of the molybdenum-manganese metallization without failure. Flexible lead wires 35 are either welded or brazed to the first and second ends 33 and 34 of the metallized transducer windings 21. The high strength of ceramic materials will help to prevent the voice coil form 20 from distorting from its desired circular geometry because the ceramic voice coil form 20 is machined from a solid uniform piece of ceramic material without mechanical flaws and discontinuities. Another advantage is that ceramic materials can be machined to very high tolerances if so desired. Fastening the ceramic voice coil form 20 to other materials is possible by brazing the metallized end of the ceramic voice coil form 20 to metals. An option to brazing is to install a screw connection to a paper, metal, plastic or other types of diaphragm-cones for loudspeaker systems.

The improved voice coil assembly 11 will handle extremely high power pulses due to its solid state contstruction regardless of its temperature. The metallized transducer windings 21 become part of the ceramic voice coil form 20 after the firing process thereby making it desirable for high speed head positioners used in computer disc drives.

From the foregoing it can be seen that an improved voice coil assembly which has a ceramic voice coil form and metallized transducer windings formed by a molybdenum-manganese metallization onto the voice coil form has been described. It should be noted that the sketches are not drawn to scale and that distances of and between the figures are not to be considered significant.

Accordingly it is intended that the foregoing disclosure and showing made in the drawing shall be considered only as an illustration of the principles of the present invention.

What is claimed is:

1. An improved voice coil assembly comprising:

a. a ceramic voice coil form which is formed out of a high temperature ceramic material and which has an outer surface and an inner surface;

b. transducer windings having a first end and second end which are formed by a molybdenum-manganese metallization which is disposed on said outer surface of said voice coil form; and c. lead wires mechanically and electrically coupled to said first and second ends of said transducer windings.

2. An improved voice coil assembly according to claim 1 wherein said lead wires are brazed to said ends of said transducers windings.

3. An improved voice coil assembly according to claim 1 wherein said lead wires are welded to said ends of said transducers windings.

4. An improved voice coil assembly according to claim 1 wherein the resistance of said transducers windings is tightly controlled by electrolytic plating of a conductive metal.

5. An improved voice coil assembly according to claim 1 wherein the resistance of said transducers windings is tightly controlled by electroless plating of a conductive metal.

6. An improved voice coil assembly according to claim 1 wherein said transducers windings is laser trimmed in order to precisely control the resistance of said transducer windings.

7. An improved voice coil assembly according to claim 1 wherein said transducers windings are dipped into an acidic solution in order to precisely control the resistance of said transducer windings.

* * * * *